US007877943B2

(12) United States Patent
Hikai

(10) Patent No.: US 7,877,943 B2
(45) Date of Patent: Feb. 1, 2011

(54) EXTERNAL CORNER MEMBER, CONSTRUCTING STRUCTURE OF EXTERNAL CORNER PORTION AND CONSTRUCTION METHOD OF EXTERNAL CORNER PORTION USING THE SAME

(75) Inventor: Satoshi Hikai, Nagoya (JP)

(73) Assignee: Nichiha Corporation, Nagoya-shi (JP)

( * ) Notice: Subject to any disclaimer, the term of this patent is extended or adjusted under 35 U.S.C. 154(b) by 131 days.

(21) Appl. No.: 12/232,860

(22) Filed: Sep. 25, 2008

(65) Prior Publication Data

US 2009/0084053 A1 Apr. 2, 2009

(30) Foreign Application Priority Data

Sep. 28, 2007 (JP) ..... JP2007-256525

(51) Int. Cl.
*E04B 2/00* (2006.01)

(52) U.S. Cl. ..... 52/288.1; 52/287.1; 52/254; 52/279; 52/281

(58) Field of Classification Search ..... 52/288.1, 52/287.1, 254, 279, 280, 281, 745.1
See application file for complete search history.

(56) References Cited

U.S. PATENT DOCUMENTS 2,373,789 A * 4/1945 Smith ..... 52/282.3
3,109,207 A * 11/1963 Cooper ..... 52/255
3,559,356 A * 2/1971 Koral ..... 52/254
3,722,166 A * 3/1973 McNerney ..... 52/288.1
4,161,853 A * 7/1979 Weiss et al. ..... 52/288.1
4,621,471 A * 11/1986 Kuhr et al. ..... 52/288.1
4,642,957 A * 2/1987 Edwards ..... 52/242
5,363,617 A * 11/1994 Miller ..... 52/288.1
5,398,469 A * 3/1995 Logan ..... 52/288.1
5,575,131 A * 11/1996 Menchetti ..... 52/745.09
5,836,123 A * 11/1998 Gulino ..... 52/288.1

(Continued)

FOREIGN PATENT DOCUMENTS

JP 2000-345682 A 12/2000

(Continued)

*Primary Examiner*—Brian E Glessner
*Assistant Examiner*—Joshua Ihezie
(74) *Attorney, Agent, or Firm*—Birch, Stewart, Kolasch & Birch, LLP

(57) ABSTRACT

To provide an external corner member with excellent workability, which can be constructed on an external corner portion of a building without making a noticeable gap formed in abutting portion and without using any sealing material, a constructing structure of external corner portion using the external corner member, and a construction method of external corner portion. The present invention is an external corner wall material, which is obtained by disposing two plate material at substantially a right angle, and which has abutting portion that is obtained by abutting an inclined end surface of each plate material to an inclined end surface of the right or left external wall board disposed adjacent to the plate material, and a cutout portion that is provided behind the abutting portion. The present invention includes also a base joiner having a positioning guide for attaching external wall, a constructing structure of external corner portion using the external corner wall material and the base joiner, and a construction method of external corner portion. The external corner wall material and external wall board are abutted to each other, and the positioning guide for attaching external wall is disposed in a cutout portion formed in an end portion of the external corner wall material.

2 Claims, 9 Drawing Sheets

U.S. PATENT DOCUMENTS

| | | | | |
|---|---|---|---|---|
| 6,311,442 | B1 * | 11/2001 | Watanabe | 52/282.3 |
| 6,427,401 | B2 * | 8/2002 | Bennett | 52/288.1 |
| 6,526,712 | B2 * | 3/2003 | Brooks et al. | 52/287.1 |
| 6,631,600 | B2 * | 10/2003 | Schiedegger et al. | 52/658 |
| 6,779,313 | B2 * | 8/2004 | Smythe, Jr. | 52/255 |
| 6,817,153 | B2 * | 11/2004 | Steinberg et al. | 52/592.1 |
| 6,990,776 | B2 * | 1/2006 | Berman | 52/311.1 |
| 2001/0037617 | A1 * | 11/2001 | Chi | 52/288.1 |
| 2001/0054266 | A1 * | 12/2001 | Bennett | 52/312 |
| 2002/0088189 | A1 * | 7/2002 | Honda | 52/287.1 |
| 2003/0226327 | A1 * | 12/2003 | Perry | 52/287.1 |
| 2004/0118062 | A1 * | 6/2004 | Meijer et al. | 52/287.1 |
| 2006/0070324 | A1 * | 4/2006 | Daly | 52/287.1 |
| 2006/0101746 | A1 * | 5/2006 | Smythe | 52/287.1 |
| 2008/0092470 | A1 * | 4/2008 | Jackson | 52/288.1 |
| 2009/0038247 | A1 * | 2/2009 | Taylor et al. | 52/287.1 |
| 2009/0139168 | A1 * | 6/2009 | Grissom et al. | 52/288.1 |

FOREIGN PATENT DOCUMENTS

| | | | |
|---|---|---|---|
| JP | 2003-328529 | A | 11/2003 |

* cited by examiner

EXTERNAL CORNER MEMBER, CONSTRUCTING STRUCTURE OF EXTERNAL CORNER PORTION AND CONSTRUCTION METHOD OF EXTERNAL CORNER PORTION USING THE SAME

CROSS-REFERENCE TO RELATED APPLICATION

This application claims priority under 35 U.S.C. §119 to Japanese Patent Application No. 2007-256525 filed on Sep. 28, 2007, the entire disclosure of which is incorporated herein by reference in its entirety.

BACKGROUND OF THE INVENTION

1. Field of the Invention

The present invention relates to an external corner member, a constructing structure of external corner portion and a construction method of external corner portion using the same for a constructing external wall material on an external corner portion of a building without using any sealing material.

2. Description of the Related Art

When external wall board such as siding is attached on an external corner portion of a building, an external corner wall material is used to attach, and the external wall boards are attached to each side. Then, sealing material is poured into the right and left connections between the external corner wall material and the external wall boards for preventing water from infiltrating into the building through the connections. As the sealing material, a wet sealing material and a dry sealing material are known. The wet sealing material comprises a silicone or other resin, and it is poured and dried in a construction site. The dry sealing material is a previously-molded waterproof material, and it is engaged.

FIG. 8 shows an example of a conventional constructing structure of external corner portion in which the wet sealing material is used. As shown in FIG. 8, in the external covering of a building, waterproof papers G and furring strips H are installed sequentially to external side of a column F, and then an external corner wall material J and an external wall board K are attached to the column F by a fastening member I via the furring strips H. For pouring a sealing material M into the connections between the external corner wall material J and the external wall board K, a hat joiner L is installed to the interior side of the connection between the external corner wall material J and the external wall board K, so that a space (width, depth) for pouring the sealing material M is secured by the hat-shaped protruding portion of the hat joiner L. The sealing material M is poured into the space created between the surface of the protruding portion of the hat joiner L and the connection between the external corner wall material J and the external wall board K, so that side surfaces of the external corner wall material J are bonded to side surface of the external wall boards K and water does not infiltrate into the building. Similarly, another external corner wall material J and another external wall board K are attached on top of the constructed external corner wall material J and external wall board K, whereby the external wall is completed.

On the other hand, there is also a constructing structure of external corner portion for attaching an external wall material onto an external corner portion of a building without using a sealing material (see Japanese Patent Laid-Open No. 2000-345682).

FIG. 9 shows an example of constructing structure of external corner portion without using a sealing material. In the constructing structure of external corner portion of Japanese Patent Laid-Open No. 2000-345682, shiplap portions formed on both side edges of corner materials N configuring external corners are engaged to shiplap portions formed on sidings O, as shown in FIG. 9.

Moreover, there is another constructing structure of external corner portion without using a sealing material (see Japanese Patent Laid-Open No. 2003-328529).

As shown in FIG. 10, an external corner wall material P and external wall board Q are abutted to each other and a hat joiner S and packing E that are provided with waterproof materials R are used on the interior side of the vertical connection between the external corner wall material P and the external wall board Q.

However, the constructing structure of external corner portion with the sealing material has the following problems: (1) the durability and waterproof performance of the exposed sealing material becomes degraded due to age-related deterioration thereof, resulting in discoloration and degradation of the appearance; (2) the use of the sealing material inflates the construction cost; and (3) time and effort is involved in constructing the sealing material.

In the constructing structure of external corner portion disclosed in Japanese Patent Laid-Open No. 2000-345682, a sealing material is not poured into the connection between each corner material N and the sidings O, so that the problems (1) to (3) described above do not occur. But the following new problem arises: (4) shiplaps need to be processed in a construction site, which requires labor and increases the construction cost.

In the constructing structure of external corner portion disclosed in Japanese Patent Laid-Open No. 2003-328529, the problems (1) to (3) described above do not occur because a sealing material is not poured into the connection between the external corner wall material P and the external wall board Q, and the abovementioned problem (4) does not occur either because the external corner wall material P and the external wall board Q are abutted together. However, it is necessary to cut the external wall board Q at a construction site in order to abut, so that the following new problems arise: (5) a noticeable gap is formed easily in the abutting portion; and (6) it is necessary for apply a coating on the cut portion of the external wall board Q at the construction site, but the external corner wall material P is attached first in order to determine the position of the external wall board Q, so that workability turns worse because the cut portion of the external wall board Q cannot be applied with coating after attaching.

SUMMARY OF THE INVENTION

The present invention was contrived in view of the above problems (1) to (6), and an object of the present invention is to provide an external corner member with excellent workability, which can be constructed on an external corner portion of a building without using sealing material and without making a noticeable gap formed in abutting portion. The present invention also relates to a constructing structure of external corner portion using the external corner member, and a construction method of external corner portion.

Embodiments of the invention include the following items.

Item 1: An external corner wall material for forming an external corner portion by abutting external wall boards on right and left sides, wherein the external corner wall material is formed by two plate pieces disposed to form substantially a right angle, and wherein an abutting portion is formed on the end of the plate pieces, and it is an inclined end surface which can abut an inclined end surface of the right or left external wall board disposed adjacent, and a cutout portion is formed behind the abutting portion.

Item 2: A base joiner to which the external corner wall material described in item 1 and an external wall board are attached, wherein the base joiner is formed of one plate that is bent at substantially a right angle and comprises a positioning guide for attaching external wall that protrudes to a front surface side, and wherein the positioning guide for attaching external wall is formed to be able to dispose in a cutout portion that is provided behind an end portion of the external corner wall material.

Item 3: The base joiner according to item 2, wherein a water shutoff material formed along a height direction is provided between the positioning guide for attaching external wall and an end portion thereof.

Item 4: A constructing structure of external corner portion for a building for which the external corner wall material described in item 1 and the base joiner described in item 2 are used, wherein the base joiner is attached along two sides of a column via furring strips, a water shutoff material is disposed between the positioning guide for attaching external wall of the base joiner and an end portion of the base joiner, the external corner wall material is abutted to external wall board, the positioning guide for attaching external wall of the base joiner is disposed in the cutout portion formed behind the abutting portion, and a packing is disposed in an upper/lower junction portion of the external wall board, and abutted a front surface of the water shutoff material and a back surface of the external wall board.

Item 5: A constructing structure of external corner portion for a building for which the external corner wall material described in item 1 and the base joiner described in item 3 are used, wherein the base joiner is attached along two sides of a column via furring strips, the external corner wall material is abutted to external wall board, the positioning guide for attaching external wall of the base joiner is disposed in the cutout portion formed behind the abutting portion, and a packing is disposed in an upper/lower junction portion of the external wall board, and abutted a front surface of a water shutoff material and a back surface of the external wall board.

Item 6: A construction method of external corner portion for constructing an external wall material on an external corner portion of a building, comprising the steps of:

the first step which attaches the base joiner described in item 2 along two sides of a column via furring strips;

the second step which attaches a water shutoff material between a positioning guide for attaching external wall of the base joiner and an end portion of the base joiner;

the third step which attaches, on a side adjacent to the external corner wall material, an end portion of an external wall board that is disposed adjacent to the external corner wall material to the furring strips such that the end portion is not positioned closer to the external corner wall material than the positioning guide for attaching external wall of the base joiner;

the fourth step which abuts the external corner wall material described in item 1 to the external wall board that is adjacent to the external corner wall material via the positioning guide for attaching external wall of the base joiner; and the fifth step which attaches a packing so as to bring the packing into engagement with a shiplap portion of the external wall board and bring the packing into abutment against a front surface of the water shutoff material and a back surface of the external wall board.

Item 7: A construction method of external corner portion for constructing an external wall material on an external corner portion of a building, comprising the steps of:

the first step which attaches the base joiner described in item 3 along two sides of a column via furring strips;

the second step which attaches, on a side adjacent to the external corner wall material, an end portion of an external wall board that is disposed adjacent to the external corner wall material to the furring strips such that the end portion is not positioned closer to the external corner wall material than the positioning guide for attaching external wall of the base joiner;

the third step which abuts the external corner wall material described in item 1 to the external wall board that is adjacent to the external corner wall material via the positioning guide for attaching external wall of the base joiner; and the fourth step which attaches a packing so as to bring the packing into engagement with a shiplap portion of the external wall board and bring the packing into abutment against a front surface of the water shutoff material and a back surface of the external wall board.

In order to achieve the above object, the invention described in item 1 is an external corner wall material for forming an external corner portion by abutting external wall boards on right and left sides, wherein the external corner wall material is formed by two plate pieces disposed to form substantially a right angle, and wherein an abutting portion is formed on the end of the plate pieces, and it is an inclined end surface which can abut an inclined end surface of the right or left external wall board disposed adjacent, and a cutout portion is formed behind the abutting portion.

A siding, a ceramic-based building material, an FRP molding material or the like can be used as the external corner wall material.

Although the abutting portion of the external corner wall material may be inclined at any angle, it is preferred that the inclination angle be 110 to 160 degrees with respect to a back surface of the external corner wall material. It is also preferred that an inclined surface inclining at 110 to 160 degrees with respect to a surface different from the abutting portion be provided from the front surface of the external corner wall material through the abutting portion to prevent an end of the abutting portion from breakage.

In this invention, the external corner wall material has the abutting portion. The abutting portion is formed on the end of the external corner wall material, and it is an inclined end surface, and it can abut an inclined end surface of the right or left external wall board disposed adjacent. Therefore, even when a certain size of gap is generated between the external corner wall material and the right or left external wall board when abutting the right or left external wall board to the external corner wall material, this gap can be made unnoticeable to keep a good appearance.

The invention described in item 2 is a base joiner to which the external corner wall material described in item 1 and an external wall board are attached, wherein the base joiner is formed of one plate that is bent at substantially a right angle and comprises a positioning guide for attaching external wall that protrudes to a front surface side, and wherein the positioning guide for attaching external wall is formed to be able to dispose in a cutout portion that is provided behind an end portion of the external corner wall material.

A galvalume steel plate, a galtite steel plate, an aluminum steel plate, a stainless steel plate, an alloy platings steel plate, zinc steel plate or other metallic plate can be used as the base joiner. It is preferred that the base joiner be formed by bending a single metallic plate after taking into consideration the strength and the cost of the base joiner, and that an end portion of the base joiner be folded.

It is preferred that the positioning guide for attaching external wall of the base joiner is formed by bending, and the width thereof is narrower than the width of the cutout portion that is provided behind an end portion of the external corner wall material. However, a rectangular-shape, rod-shape or cylindrical-shape member may be joined.

In this invention, the base joiner can be constructed easily on an external corner portion of a building, and the position of the base joiner cannot be shifted easily once it is constructed, because the base joiner is formed from a single plate that is bent at substantially a right angle. Furthermore, the base joiner has the positioning guide for attaching external wall, the external corner wall material and the external wall boards adjacently disposed on the right and left sides of the external corner wall material can be positioned easily, and the external wall boards can be constructed first.

The invention described in item 3 is the base joiner according to item 2, wherein a water shutoff material formed along a height direction is provided between the positioning guide for attaching external wall and an end portion thereof. As the water shutoff material, an elastic resin material, such as foamed resin material made by ethylene propylene rubber referred to as EPDM or vinyl chloride resin, is preferably used.

In this invention, the water shutoff material is formed on the base joiner beforehand, so that the work of attaching the water shutoff material can be omitted.

The invention described in item 4 is a constructing structure of external corner portion for a building for which the external corner wall material described in item 1 and the base joiner described in item 2 are used, wherein the base joiner is attached along two sides of a column via furring strips, a water shutoff material is disposed between the positioning guide for attaching external wall of the base joiner and an end portion of the base joiner, the external corner wall material is abutted to external wall board, the positioning guide for attaching external wall of the base joiner is disposed in the cutout portion formed behind the abutting portion, and a packing is disposed in an upper/lower junction portion of the external wall board, and abutted a front surface of the water shutoff material and a back surface of the external wall board. As the water shutoff material and the packings, an elastic resin material, such as foamed resin material made by ethylene propylene rubber referred to as EPDM or vinyl chloride resin, is preferably used.

In this invention, because the base joiner described in item 2 and the external corner wall material described in item 1 are used, the positioning guide for attaching external wall of the base joiner can be disposed in the cutout portion that is formed behind the abutting portion of the external corner wall material. In addition, the inclined end surface of the external corner wall material is abutted to the inclined end surface of the right or left external wall board disposed adjacent to the external corner wall material, so that the abutting portion is inclined obliquely. When the right or left adjacent external wall board is abutted to the external corner wall material, a certain size of gap might be formed between the external corner wall material and the external wall board, but the gap is not noticeable, so that it can keep a good appearance. Furthermore, when rainwater enters from the junction portion between the external corner wall material and the external wall board and flows down the connection, the rainwater moves horizontally from the intersection between the junction portion and the upper/lower junction portion of the external wall board. However, by disposing the packing and water shutoff material in the upper/lower junction portion of the external wall board, the rainwater can be prevented from moving horizontally toward the external wall board.

The invention described in item 5 is a constructing structure of external corner portion for a building for which the external corner wall material described in item 1 and the base joiner described in item 3 are used, wherein the base joiner is attached along two sides of a column via furring strips, the external corner wall material is abutted to external wall board, the positioning guide for attaching external wall of the base joiner is disposed in the cutout portion formed behind the abutting portion, and a packing is disposed in an upper/lower junction portion of the external wall board, and abutted a front surface of a water shutoff material and a back surface of the external wall board.

In this invention, the effect same as those of the invention described in item 4 can be obtained.

The invention described in item 6 is a construction method of external corner portion for constructing an external wall material on an external corner portion of a building, comprising the steps of: the first step which attaches the base joiner described in item 2 along two sides of a column via furring strips; the second step which attaches a water shutoff material between a positioning guide for attaching external wall of the base joiner and an end portion of the base joiner; the third step which attaches, on a side adjacent to the external corner wall material, an end portion of an external wall board that is disposed adjacent to the external corner wall material to the furring strips such that the end portion is not positioned closer to the external corner wall material than the positioning guide for attaching external wall of the base joiner; the fourth step which abuts the external corner wall material described in item 1 to the external wall board that is adjacent to the external corner wall material via the positioning guide for attaching external wall of the base joiner; and the fifth step which attaches a packing so as to bring the packing into engagement with a shiplap portion of the external wall board and bring the packing into abutment against a front surface of the water shutoff material and a back surface of the external wall board.

In this invention, by attaching the base joiner of item 2 having the positioning guide for attaching external wall via the furring strips of the external corner portion of the building, positions for constructing the end portion of the external wall board that is adjacent to the external corner wall material can be constant position. In addition, the positioning guide for attaching external wall is shaped into a certain sized and positioned such that it can be disposed in a dent provided on the back surface side of the abutting portion of the external corner wall material, so that when the external corner wall material is abutted to the external wall board, the positioning guide for attaching external wall is disposed in the cutout portion provided on the back surface of the abutting portion of the external corner wall material. Therefore, problem does not occur, and the effect of preventing the external wall board from slipping can be obtained. Furthermore, it is possible to attach the external wall board first, and to apply coating on the cut portion of each of the external wall board at the construction site before attaching the external corner wall material, so that workability is good.

The invention described in item 7 is a construction method of external corner portion for constructing an external wall material on an external corner portion of a building, comprising the steps of: the first step which attaches the base joiner described in item 3 along two sides of a column via furring strips; the second step which attaches, on a side adjacent to the external corner wall material, an end portion of an external wall board that is disposed adjacent to the external corner wall material to the furring strips such that the end portion is not positioned closer to the external corner wall material than the positioning guide for attaching external wall of the base joiner; the third step which abuts the external corner wall material described in item 1 to the external wall board that is adjacent to the external corner wall material via the positioning guide for attaching external wall of the base joiner; and the fourth step which attaches a packing so as to bring the packing into engagement with a shiplap portion of the external wall board and bring the packing into abutment against a front surface of the water shutoff material and a back surface of the external wall board.

In this invention, the effect same as those of the invention described in item 6 can be obtained. In addition, this invention uses the base joiner of item 3 to which the water shutoff material is formed on beforehand, so that the work of attaching the water shutoff material can be omitted.

EFFECTS OF THE INVENTION

In the external corner member of the present invention, constructing structure of external corner portion of the present invention and construction method of external corner portion of the present invention, a sealing material is not used, so that the present invention does not cause any of the following problems: the durability and waterproof performance of an exposed sealing material becomes degraded due to age-related deterioration thereof, resulting in discoloration and degradation of the appearance; the use of the sealing material inflates the construction cost; and time and effort is involved in constructing the sealing material. In addition, the external corner wall material is abutted to the external wall boards that are adjacently disposed on the right and left sides of the external wall material, it is not necessary to process shiplaps, so that construction cost can be reduced. And abutting portion is formed on the inclined surfaces, the gap formed in the abutting portion can be not noticeable, so that it can keep a good appearance. Moreover, when rainwater enters from the junction portion between the external corner wall material and the external wall board and flows down the connection, by disposing the packing and water shutoff material in the upper/lower junction portion of the external wall board, the rainwater can be prevented from moving horizontally toward the external wall board. Furthermore, effect of preventing the external wall board from slipping can be obtained. Furthermore, it is possible to attach the external wall board first, and to apply coating on the cut portion of each of the external wall board at the construction site before attaching the external corner wall material, so that workability is good.

DESCRIPTION OF THE PREFERRED EMBODIMENTS

The best mode for carrying the present invention will be described hereinafter in detail with reference to FIG. 1 to FIG. 6.

Embodiment 1

Figure 1A:
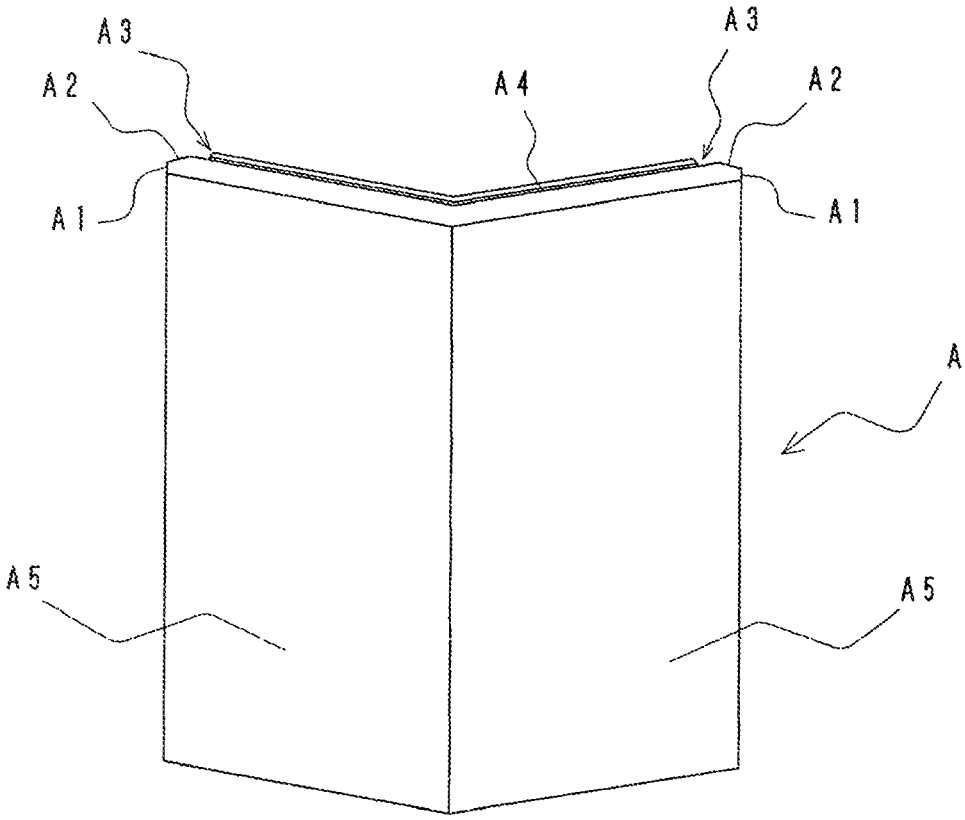
FIG. 1 is a drawing showing an example of an external corner wall material.
Figure 1B:
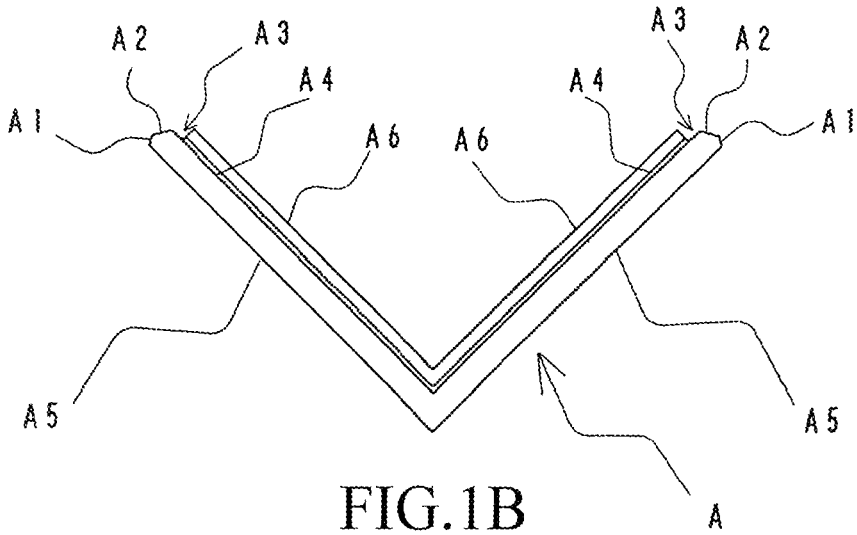

FIG. 1 is a drawing showing an example of an external corner wall material, in which FIG. 1A is a front view of the external corner wall material viewed from obliquely above, and FIG. 1B a view in which the external corner wall material is viewed from directly above.

An external corner wall material A, which is a building material mainly made from cement, sands and glass fibers, is symmetric in a width direction and has two plate materials of approximately 18 mm in thickness that are disposed to form substantially a right angle. Each of right and left end portions of the external corner wall material A is provided with an inclined surface A1, inclined surface A2 and cutout portion A3. The inclined surface A2 is abutting portion where the external corner wall material A is abutted to an adjacent external wall board at each of the right and left sides of the external corner wall material A. The angle of the inclined surface A2 is approximately 120 degrees with respect to a back surface A6 of the external corner wall material A. In addition to the inclined surface A2, another inclined surface A1 is provided between a front surface A5 of the external corner wall material A and the abutting portion of the inclined surface A2, in order to prevent the each end portion from breakage. The angle of the inclined surface A1 is approximately 120 degrees with respect to the front surface A5 of the external corner wall material A. Furthermore, the cutout portion A3 corresponding to a positioning guide for attaching external wall (described hereinafter) of a base joiner is provided on the back surface A6 side than the inclined surface A2. At the end portion of the external corner wall material A that has a thickness of approximately 18 mm, the inclined surface A1 constitutes the part with a thickness of approximately 2 mm from the front surface, while the inclined surface A2 constitutes the part with a thickness of approximately 8 mm from the inclined surface A1 to the back surface A6, and the cutout portion A3 constitutes the remaining part with a thickness of approximately 8 mm from the inclined surface A2 to the back surface. With regards to the width size of the back surface of the external corner wall material A, the width of the back surface A6 is approximately 85 mm, the width of the cutout portion A3 is approximately 2 mm, and the width of the inclined surface A2 is approximately 5 mm.

In addition, upper and lower end portions of the external corner wall material A are each provided with another cutout portion A4 for locking a fastening member.

Figure 2A:
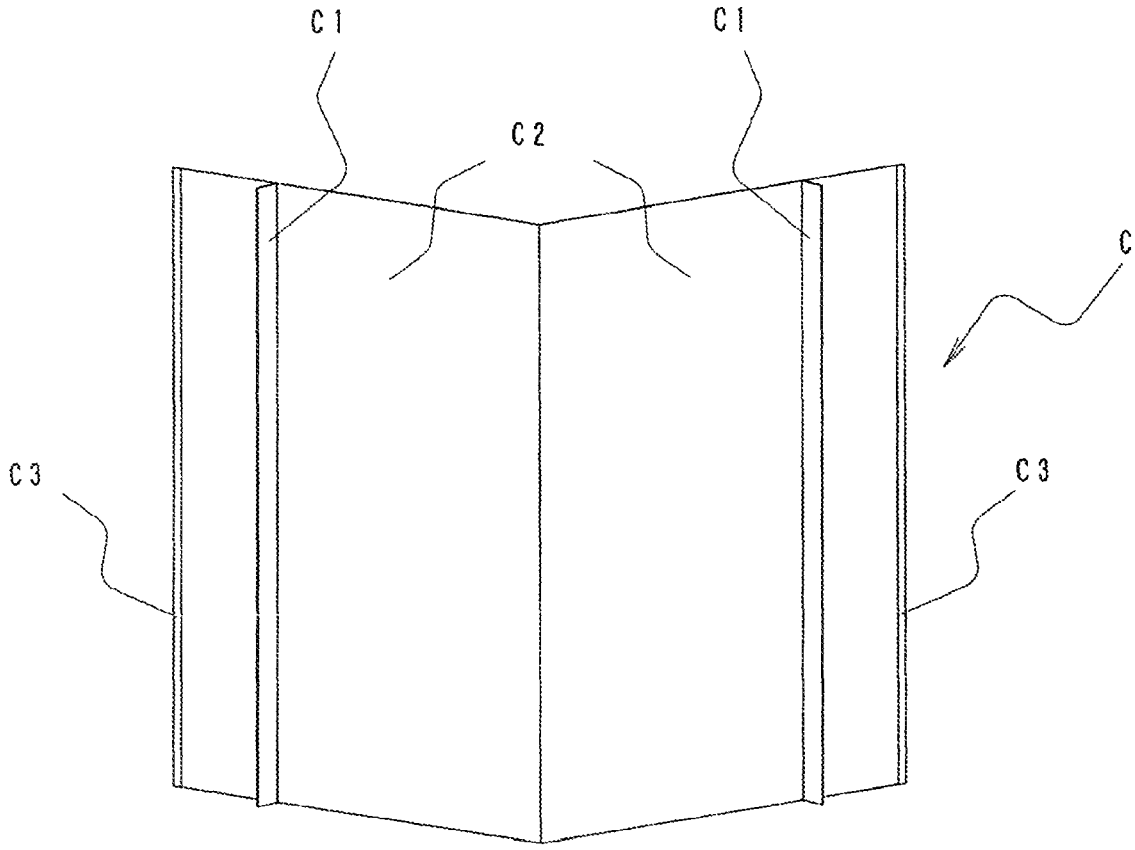
FIG. 2 is a drawing showing an example of a base joiner.
Figure 2B:
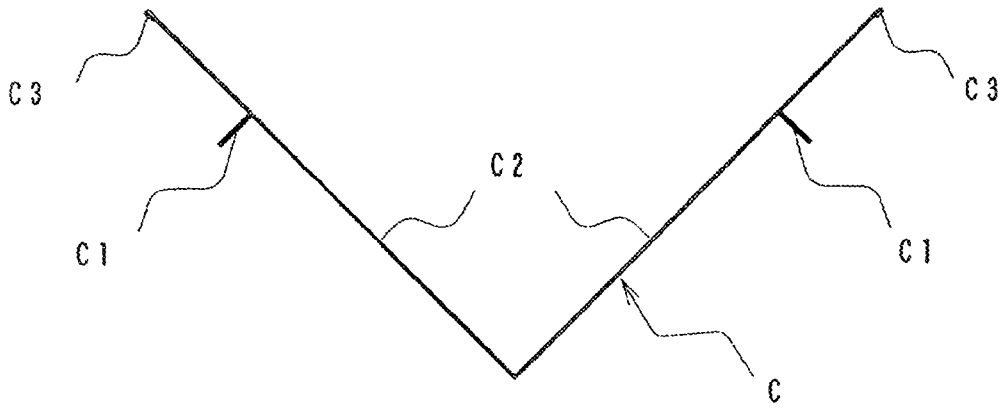

FIG. 2 is a drawing showing an example of a base joiner, wherein FIG. 2A is a front view of the base joiner viewed from obliquely above, and FIG. 2B a view in which the base joiner is viewed from directly above.

A base joiner C is formed by bending a single galvalume steel plate with a thickness of approximately 0.35 mm. An end portions C3 of the base joiner C is folded in order to achieve reinforcement of the strength and safety.

The base joiner C comprises an positioning guide for attaching external wall C1 and a base portion C2. The positioning guide for attaching external wall C1 is positioned approximately 84 mm from the intersection (center) of two sides of the base joiner C, so that width from center to the positioning guide for attaching external wall C1 is narrower than the back surface A6 of the external corner wall material A. Also, the positioning guide for attaching external wall C1 is formed by bending the galvalume steel plate to the front surface side, so that the strength of the positioning guide for attaching external wall C1 is secured. Furthermore, the width of the positioning guide for attaching external wall C1 is approximately 1 mm and is narrower than the width of the cutout portion A3 of the external corner wall material A, so that the positioning guide for attaching external wall C1 can be disposed in the cutout portion A3 of the external corner wall material A.

Figure 3A:
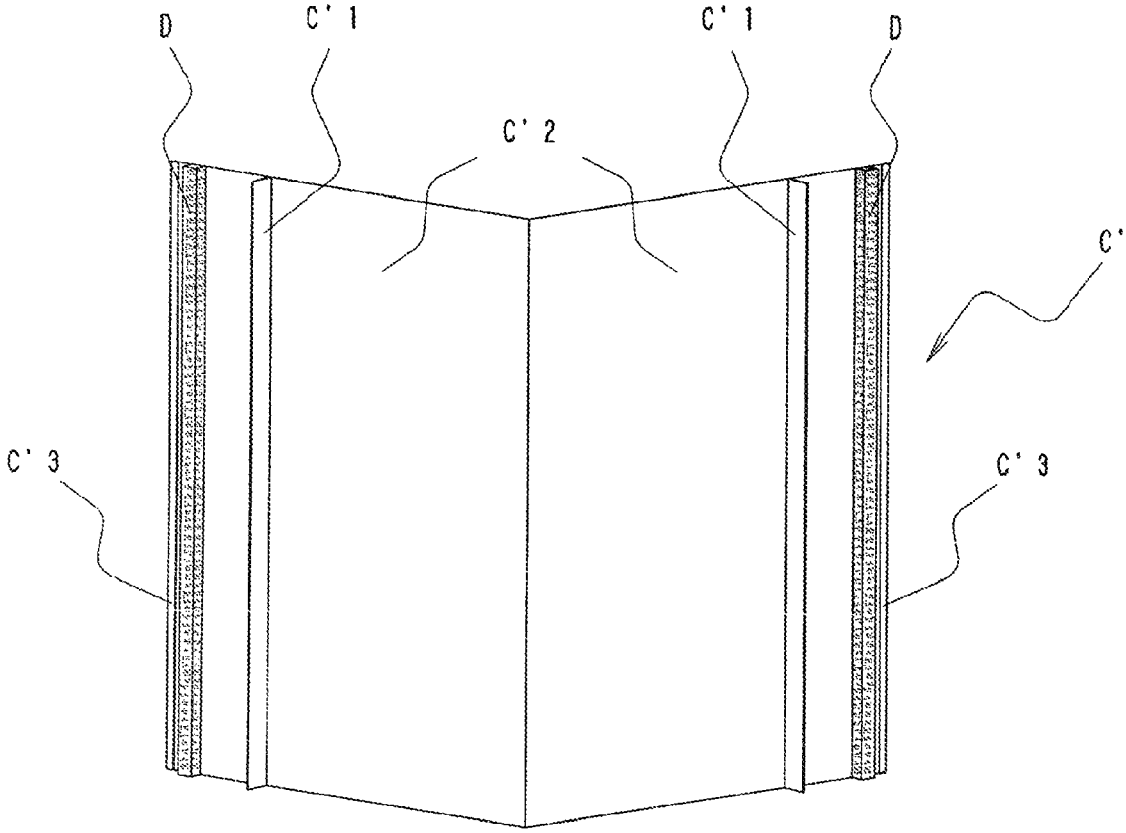
FIG. 3 is a drawing showing another example of a base joiner.
Figure 3B:
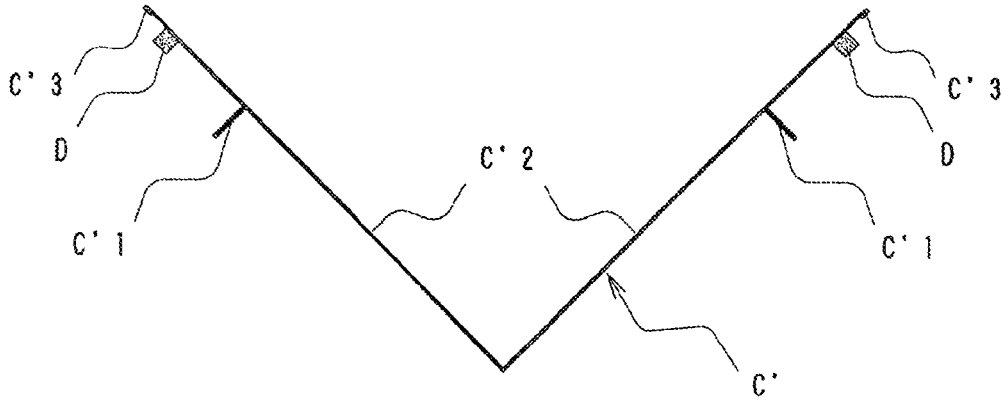

FIG. 3 is a drawing showing another example of a base joiner, wherein FIG. 3A is a front view of the base joiner viewed from obliquely above, and FIG. 3B a view in which the base joiner is viewed from directly above.

A base joiner C' is made by disposing a water shutoff material D in the base joiner C shown in FIG. 2. The water shutoff material D is a square bar with a width of 10 mm and height of 8 mm made from EPDM, and is attached to a base portion C'2 between an positioning guide for attaching external wall C'1 and an end portion C'3.

Figure 4A:
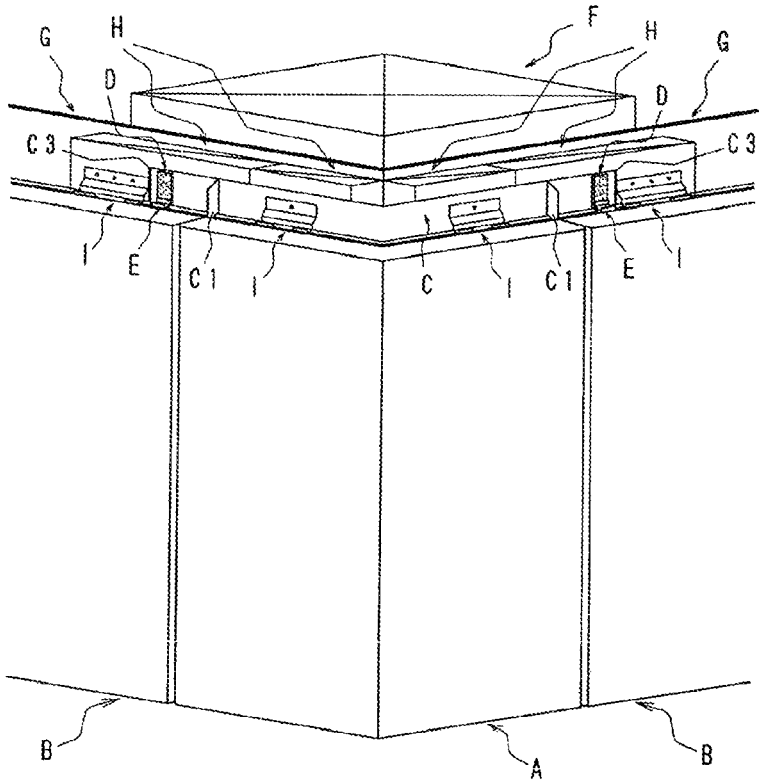
FIG. 4 is a drawing showing an example of a constructing structure of external corner portion for constructing the external corner wall material A shown in FIG. 1 and the base joiner C shown in FIG. 2.
Figure 4B:
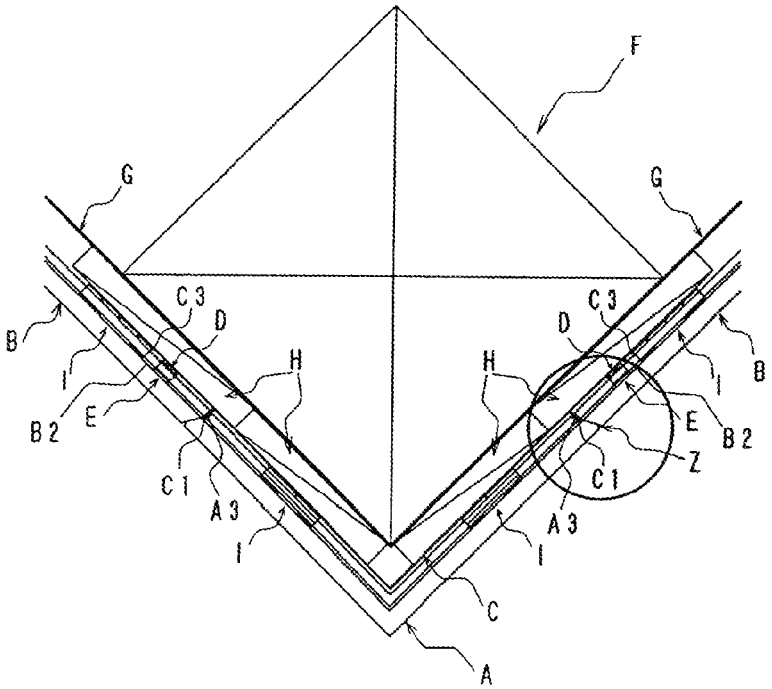
Figure 5:
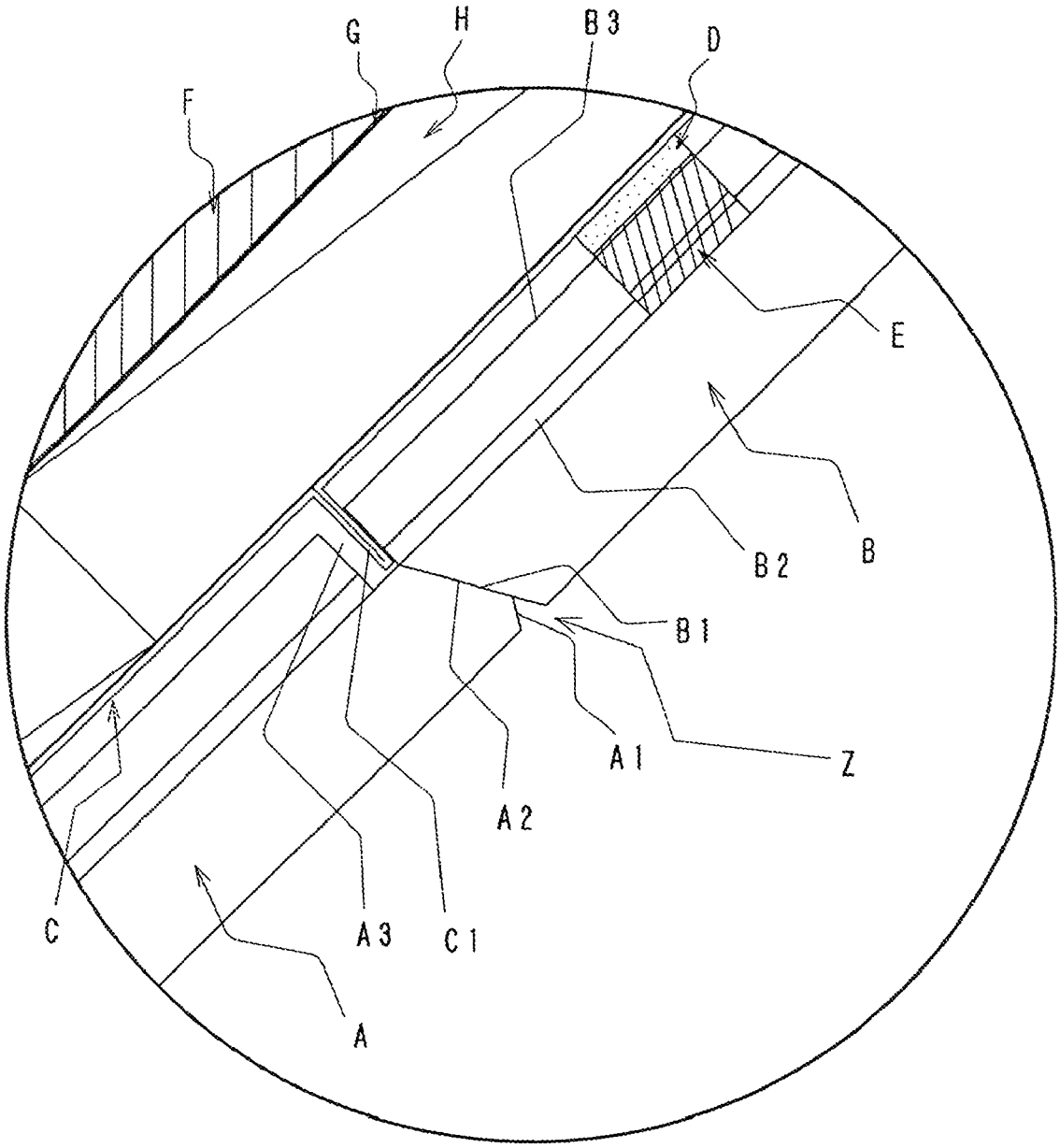
FIG. 5 is an enlarged drawing of abutting portion between the external corner wall material and an external wall board that are shown in FIG. 4B.

FIG. 4 is a drawing showing an example of a constructing structure of external corner portion for constructing the external corner wall material A shown in FIG. 1 and the base joiner C shown in FIG. 2, wherein FIG. 4A is a front view of the constructing structure of external corner portion viewed from obliquely above, and FIG. 4B a view in which the constructing structure of external corner portion is viewed from directly above. FIG. 5 is an enlarged drawing of abutting portion Z between the external corner wall material A and an external wall board B that are shown in FIG. 4B.

A constructing structure of external corner portion comprises a column F, a waterproof paper G, furring strips H, the base joiner C, the water shutoff materials D, packings E, the external corner wall material A, and the external wall boards B.

The furring strips H in the condition which press the waterproof paper G are fixed to two sides of the column F by nails (not shown), and prevent the entry of rainwater into the building.

The base joiner C is attached to the furring strips H along the orthogonal front surface of the column F, and is not slipped after attaching.

The water shutoff material D is a square bar with a width of 10 mm and height of 8 mm made from EPDM, and is attached between the positioning guide for attaching external wall C1 and end portion C3 of the base joiner C. And each of the external wall boards B has an inclined surface B1 at its end portion that is abutted to the external corner wall material A. The external corner wall material A and external wall board B are attached to the furring strips H by a fastening member I, so that the inclined surface A2 and the inclined surface B1 are abutted to each other outside the base joiner C. Therefore, the abutting portion between the external corner wall material A and the external wall board B (abutting portion between the inclined surface A2 and the inclined surface B1) is an inclined abutting surface. When the external wall board B is abutted to the external corner wall material A, a certain size of gap might be formed between the external corner wall material A and the external wall board B (between the inclined surface A2 and the inclined surface B1), but the gap is not noticeable, so that it can keep a good appearance. And the positioning guide for attaching external wall C1 of the base joiner C is disposed in the cutout portion A3 formed on the back of the abutting portion of the external corner wall material A, so that no problem arises in this part. In addition, a back surface of the external wall board B is attached in contact with a front surface of the water shutoff material D, so that the water shutoff material D can prevent the rainwater from moving horizontally toward the external wall board B after the rainwater enters from the junction portion between the external corner wall material A and the external wall board B and falls.

Each packing E is made from EPDM and has a width of 10 mm, which is the same as the width of the water shutoff material D. The packing E is engaged with a cutout portion B2 formed in a upper shiplap portion, and is in contact with the front surface of the water shutoff material D and back surface of the external wall board B. Although not shown in FIG. 4, another external corner wall material A is formed further attached above and below the external corner wall material A and another external wall board B is further attached above and below the external wall board B, whereby an external corner portion of the building is completed. When attaching another external wall board B above and below the external wall board B, the packing E is engaged with the cutout portion B2 that is formed in a lower shiplap portion of the upper external wall board B, and is disposed in contact with the front surface of the water shutoff material D and a back surface of the upper external wall board B. By engaging the packing E with the cutout portion B2 formed in the lower shiplap portion of the upper external wall board B and with the cutout portion B2 formed in the upper shiplap portion of the lower external wall board B as described above, the packing E can be fastened, and a horizontal space that is formed in the upper/lower junction portion by abutting the two upper and lower external wall boards B can be closed. In addition, the space that is formed between a back surface B3 of the external wall board and the front surface of the water shutoff material D can be closed, so that the rainwater that enters from the junction portion between the external corner wall material A and the external wall board B can be prevented from moving horizontally toward the external wall board B at the intersection between the junction portion and the upper/lower junction portion of the external wall board B.

In addition, the constructing structure of external corner portion shown in FIG. 4 and FIG. 5 can be obtained even when using the base joiner C' shown in FIG. 3.

In a construction method of external corner portion shown in FIG. 4 and FIG. 5, first the furring strips H in the condition which press the waterproof paper G are fixed to two sides of front surfaces of the column F that form a right angle by nails, and then the base joiner C shown in FIG. 2 is attached to the furring strips H along the orthogonal front surface of the column F.

Next, the water shutoff material D is attached between the positioning guide for attaching external wall C1 and the end portion C3 of the base joiner C.

The inclined surface B1 is formed on the end portion of the external wall board B that is adjacent to the external corner wall material A, and the external wall board B is attached to the furring strips H by the fastening bracket I such that the end portion is not positioned closer to the external corner wall material A than the positioning guide for attaching external wall C1 of the base joiner C. The inclined surface B1 is poor in water resistance because it is formed by cutting. However, in this construction method, the inclined surface B1 can be applied with coating even after the external wall board B is attached to the furring strips H before the external corner wall material A is abutted to the inclined surface B1. Therefore, water resistance can be obtained by applying coating on the inclined surface B1. Also, the external wall board B is attached such that the back surface B3 comes into contact with the front surface of the water shutoff material D.

Moreover, the external corner wall material A is abutted to external wall board B such that the inclined surface A2 is abutted to the inclined surface B1 of the adjacent external wall board B, and the cutout portion A3 is disposed so as to correspond to the positioning guide for attaching external wall C1 of the base joiner C, and external corner wall material A is attached to the furring strips H by the fastening member I.

The packing E is attached such that it comes into contact with the front surface of the water shutoff material D and the back surface B3 of the external wall board B and is engaged with the cutout portion B2 formed on the upper shiplap portion of the external wall board B. When attaching another external wall board B above the external wall board B, the packing E is attached such that it is engaged with the cutout portion B2 formed on the lower shiplap portion of the upper external wall board B and comes into contact with the front surface of the water shutoff material D and the back surface of the upper external wall board B.

By using the above construction method, the external wall material can be constructed first, and the work of applying coating on the cut portion of the external wall board at the construction site can be performed subsequently. Consequently, improved workability can be achieved. In addition, the base joiner C' shown in FIG. 3 may be used, in which case the work of attaching the water shutoff material D is omitted.

Figure 6A:
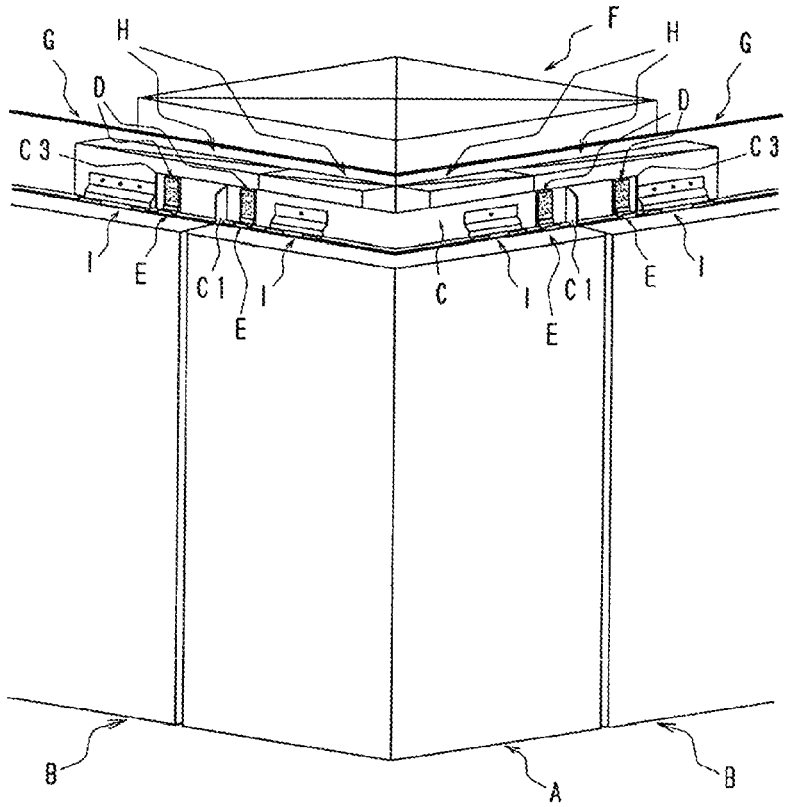
FIG. 6 is a drawing showing another example of a constructing structure of external corner portion for constructing the external corner wall material A shown in FIG. 1 and the base joiner C shown in FIG. 2.
Figure 6B:
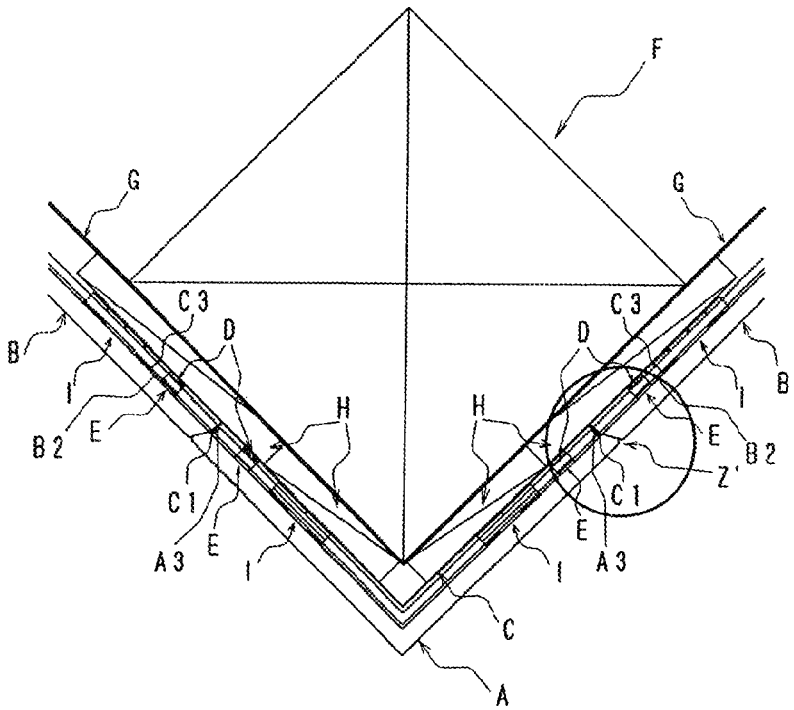
Figure 7:
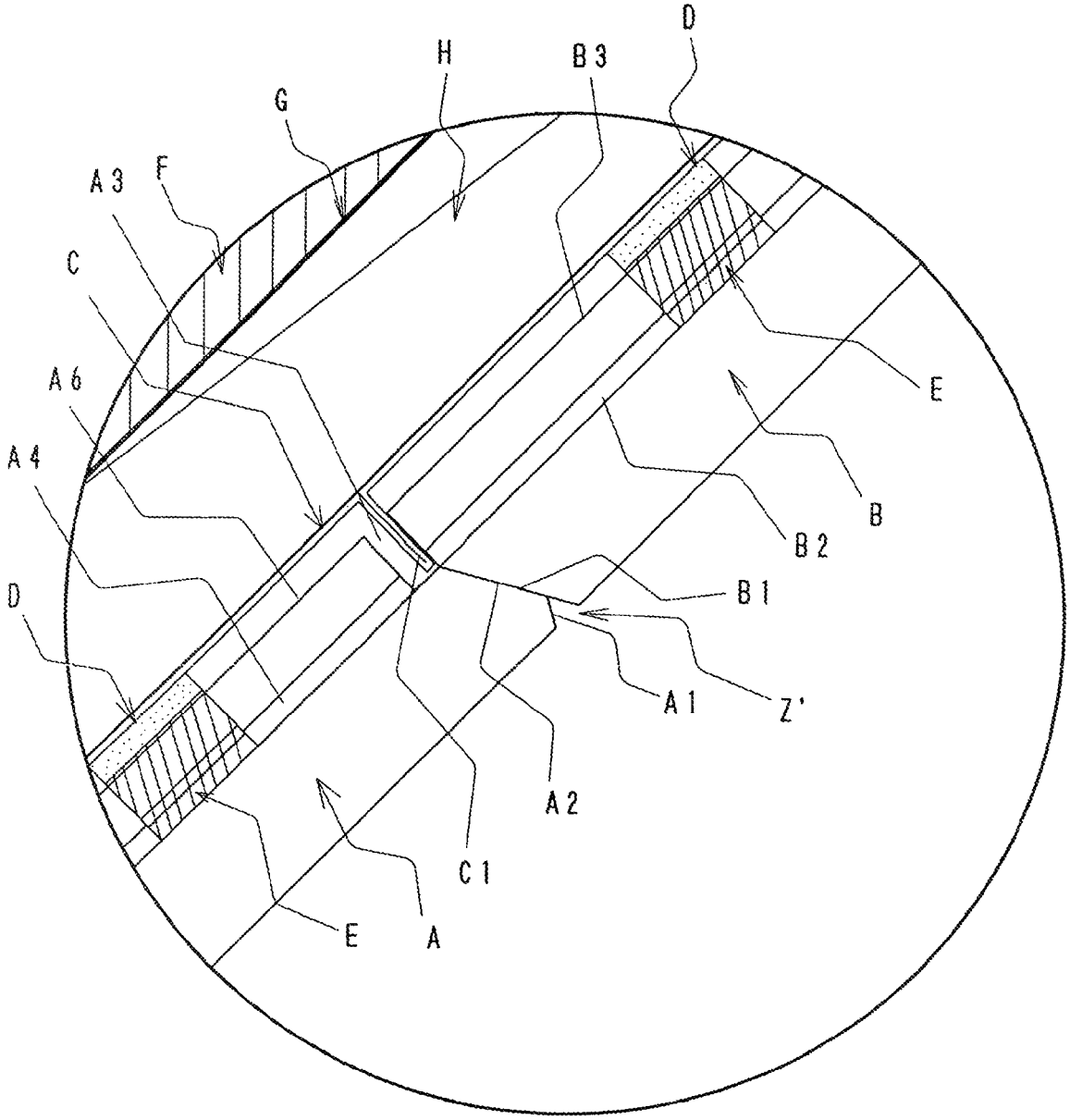
FIG. 7 is an enlarged drawing of abutting portion between the external corner wall material and external wall board shown in FIG. 6B.
Figure 8:
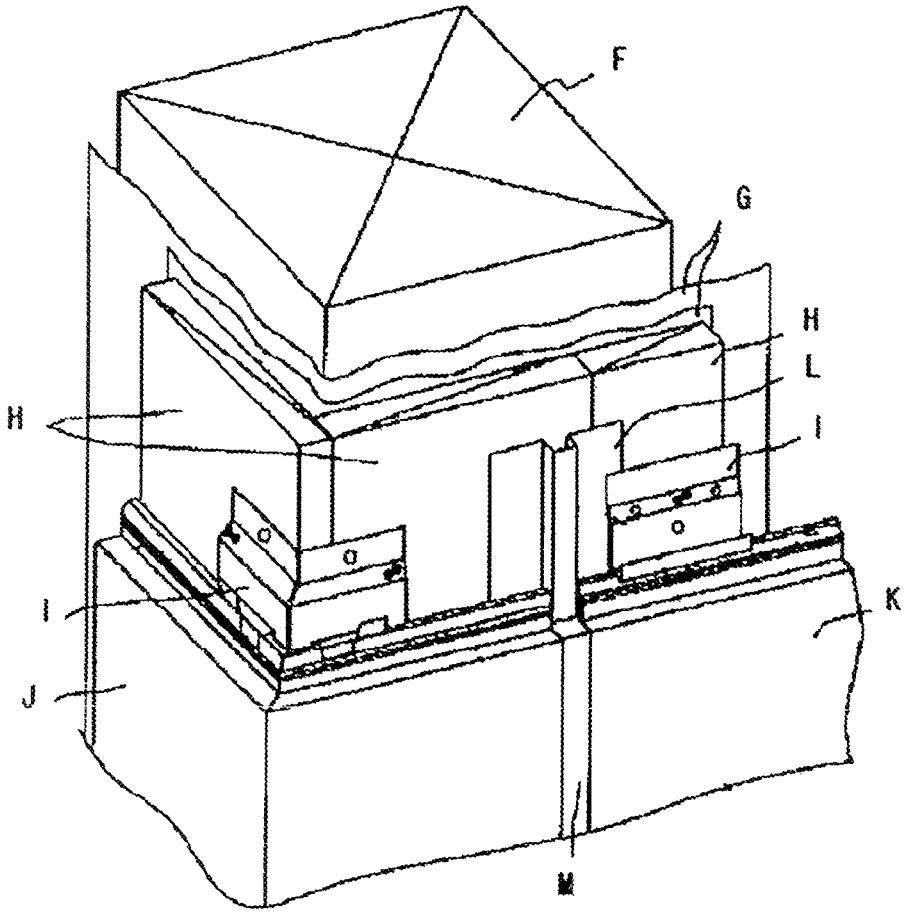
FIG.8 PRIOR ART
FIG. 8 is a drawing showing an example of a constructing structure of external corner portion in which a wet sealing material is used.
Figure 9:
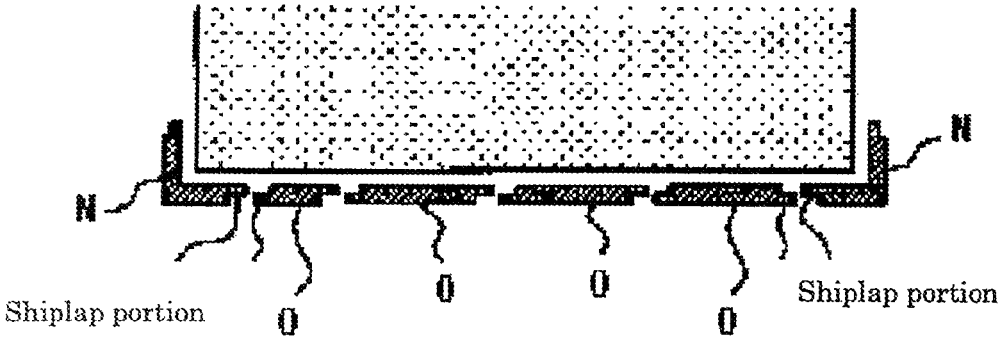
FIG.9 PRIOR ART
FIG. 9 is a drawing showing an example of a conventional constructing structure of external corner portion in which a sealing material is not used.
Figure 10:
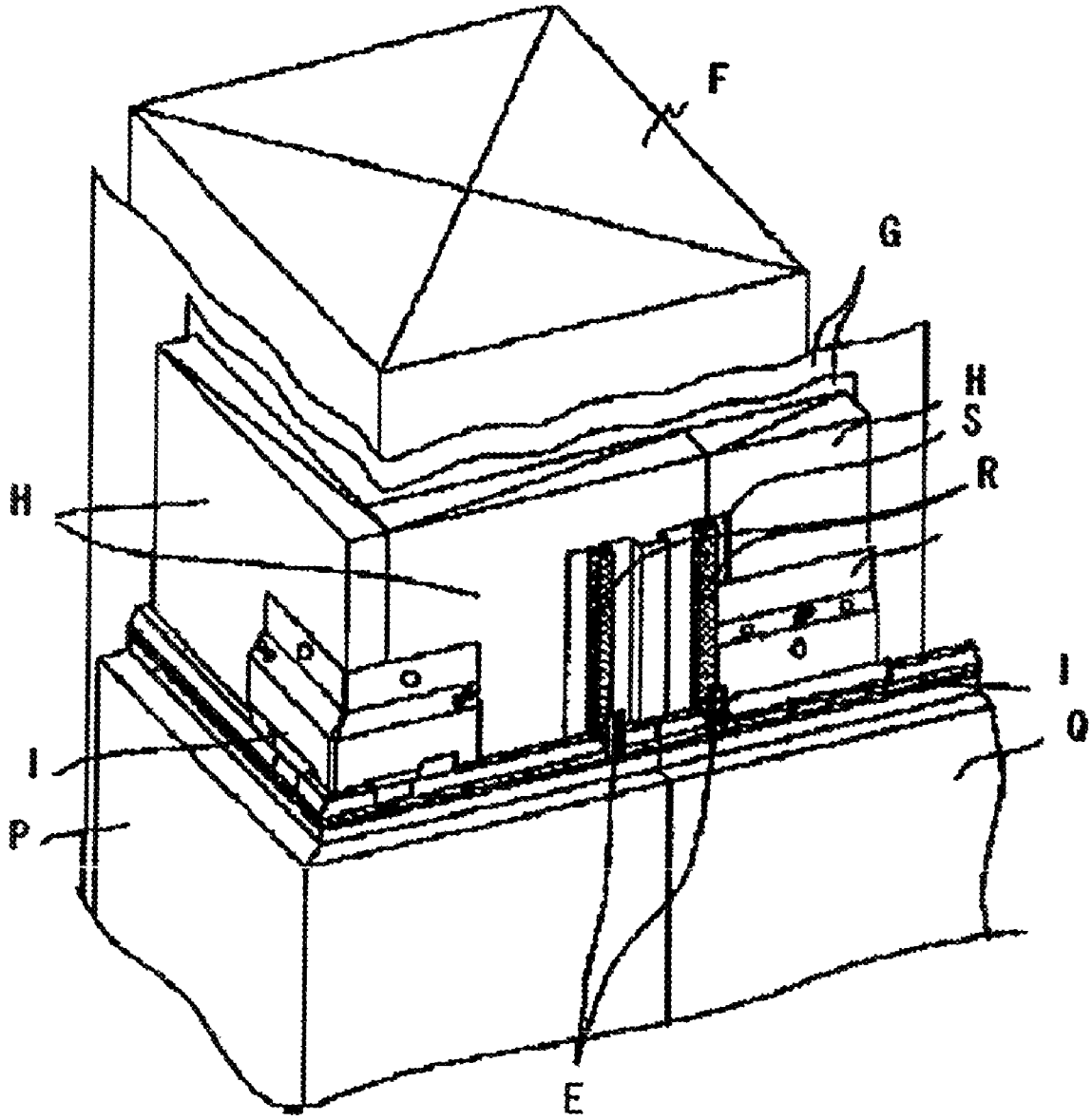
FIG.10 PRIOR ART
FIG. 10 is a drawing showing another example of a conventional constructing structure of external corner portion in which a sealing material is not used.

FIG. 6 is a drawing showing another example of a constructing structure of external corner portion for constructing the external corner wall material A shown in FIG. 1 and the base joiner C shown in FIG. 2, wherein FIG. 6A is a front view of the constructing structure of external corner portion viewed from obliquely above, and FIG. 6B is a view in which the constructing structure of external corner portion is viewed from directly above. FIG. 7 is an enlarged drawing of abutting portion Z' between the external corner wall material A and the external wall board B shown in FIG. 6B.

As with the constructing structure of external corner portion shown in FIG. 4 and FIG. 5, the constructing structure of external corner portion shown in FIG. 6 and FIG. 7 also comprises the column F, waterproof paper G, furring strips H, base joiner C, water shutoff materials D, packings E, external corner wall material A and external wall boards B. However, the difference between the constructing structure of external corner portion shown in FIG. 6 and FIG. 7 and the constructing structure of external corner portion shown in FIG. 4 and FIG. 5 is that the former constructing structure of external corner portion has the water shutoff materials D and packings E provided on the external corner wall material A as well. Specifically, in addition to the constructing structure of external corner portion shown in FIG. 4 and FIG. 5, another water shutoff material D is attached such that its front surface comes into contact with the back surface A6 of the external corner wall material A. Moreover, the packing E having the same width as the water shutoff material D is engaged with the cutout portion A4 formed on the upper shiplap portion of the external corner wall material A and is attached in contact with the front surface of the water shutoff material D and the back surface A6 of the external corner wall material A. Therefore, even when rainwater enters from the abutting portion Z between the external corner wall material A and the external wall board B, it is prevented from moving horizontally toward the external corner wall material A when falling down. The rest of the constructing structure of external corner portion shown in FIG. 4 and FIG. 7 is the same as the constructing structure of external corner portion shown in FIG. 4 and FIG. 5, so that the constructing structure of external corner portion shown in FIG. 6 and FIG. 7 can be achieved the abovementioned effects of the constructing structure of external corner portion shown in FIG. 4 and FIG. 5. And the constructing structure of external corner portion shown in FIG. 6 and FIG. 7 can be obtained even when the base joiner C' shown in FIG. 3 is used.

Although a construction method of external corner portion shown in FIG. 6 and FIG. 7 is similar to the construction method of external corner portion shown in FIG. 4 and FIG. 5, the difference is how the water shutoff material D and packing E are attached. Specifically, the water shutoff material D is attached between the positioning guide for attaching external wall C1 and end portion C3 of the base joiner C, and another water shutoff material D is attached between the center of the base joiner C and the positioning guide for attaching external wall C1. Accordingly, the packing E is attached such that it comes into contact with the front surface of the water shutoff material D and the back surface B3 of the external wall board B and is engaged with the cutout portion B2 formed on the upper shiplap portion of the external wall board B. Also, another packing E is attached such that it comes into contact with the front surface of the water shutoff material D and the back surface A6 of the external corner wall material A and is engaged with the cutout portion A4 formed on the upper shiplap portion of the external corner wall material A.

With this construction method, the same effects as those of the constructing structure of external corner portion shown in FIG. 4 and FIG. 5 can be achieved.

The above has described an embodiment of the present invention, but the present invention is not limited to this embodiment, and various modifications are possible within the scope of the inventions described in patent claims. For example, for the external corner wall material, an external wall board made of a different material or an external wall board of various thickness may be used. Also, since the shiplap portion of each external wall board is formed into various shapes, the shapes of packing may be changed according to the shape of the shiplap portion of the external wall board, and a variety of fastening members can be used.

As described above, according to the external corner member of the present invention, constructing structure of external corner portion of the present invention and construction method of external corner portion of the present invention, a sealing material is not used, so that the present invention does not cause any of the following problems: the durability and waterproof performance of an exposed sealing material becomes degraded due to age-related deterioration thereof, resulting in discoloration and degradation of the appearance; the use of the sealing material inflates the construction cost; and time and effort is involved in constructing the sealing material. In addition, the external corner wall material is abutted to the external wall boards that are adjacently disposed on the right and left sides of the external wall material, it is not necessary to process shiplaps, so that construction cost can be reduced. And abutting portion is formed on the inclined surfaces, the gap formed in the abutting portion can be not noticeable, so that it can keep a good appearance. Moreover, when rainwater enters from the junction portion between the external corner wall material and the external wall board and flows down the connection, by disposing the packing and water shutoff material in the upper/lower junction portion of the external wall board, the rainwater can be prevented from moving horizontally toward the external wall board. Furthermore, effect of preventing the external wall board from slipping can be obtained. Furthermore, it is possible to attach the external wall board first, and to apply coating on the cut portion of each of the external wall board at the construction site before attaching the external corner wall material, so that workability is good.

What is claimed is:

1. A constructing structure of external corner portion for a building, comprising:

an external corner wall material for forming an external corner portion by abutting external wall boards on each side, the external corner wall material comprising:

two plate pieces being disposed to form substantially a right angle, wherein each of the plate pieces has an abutting portion at an end of each of the plate pieces, the abutting portion having an inclined end surface which can abut an inclined end surface of an external wall board disposed adjacent, a cutout portion formed behind the abutting portion, and a cutout portion formed on an upper shiplap portion;

a base joiner to which the external corner wall material and an external wall board are installed, the base joiner comprising:

a plate that is bent at substantially a right angle, a positioning guide for installing the external wall board and the external corner wall material to the base joiner, the positioning guide protruding out to a front surface side of the plate, the positioning guide being disposed so that the cutout portion formed behind the abutting portion of the external corner wall material can be disposed along with the positioning guide, and a water sealing material disposed along a height direction of the base joiner and between the positioning guide and an end portion of the plate; and an external wall board having an inclined end surface at an end thereof, wherein the base joiner is attached along two sides of a column via furring strips, the external corner wall material is abutted to the external wall board so that the inclined surface of the external corner wall material is mated with the inclined surface of the external wall board, the positioning guide of the base joiner is disposed in the cutout portion formed behind the abutting portion, and a packing is disposed at upper and lower junction portions of the external wall board, and abutting a front surface of the water sealing material and a back surface of the external wall board.

2. A construction method of external corner portion for constructing an external wall material on an external corner portion of a building, comprising the steps of:

Installing a base joiner along two sides of a column via furring strips, the base joiner comprising:

a plate having a bent part of a substantially right angle, a positioning guide for installing an external wall board and an external corner wall material to the base joiner, the positioning guide protruding out to a front surface side of the plate, the positioning guide being disposed so that a first cutout portion of the external corner wall material can be disposed along with the positioning guide;

installing a water sealing material along a height direction of the base joiner and between the positioning guide and an end portion of the base joiner;

installing, on a side adjacent to a portion where the external corner wall material is to be installed, an external wall board having a shiplap portion and an inclined end surface; the external wall board attached to the furring strips such that an end portion of the external wall board is adjacent to the positioning guide of the base joiner;

disposing an external corner wall material at the bent part of the base joiner, the external corner wall material comprising:

two plates pieces being disposed to form substantially a right angle, wherein each of the plate pieces has an abutting portion at an end of each of the plate pieces, the abutting portion having an inclined end surface, the first cutout portion formed behind the abutting portion of the external corner wall material, and a second cutout portion formed on an upper shiplap portion, so that the external corner wall material is abutted to the external wall board via the positioning guide of the base joiner and the inclined end surface of the external wall board is mated with the inclined end surface of the external corner wall material; and installing a packing so that the packing is brought into engagement with the shiplap portion of the external wall board and the packing is brought into abutment against a front surface of the water sealing material and a back surface of the external wall board.

* * * * *